US012121126B2

(12) United States Patent
Costantini

(10) Patent No.: US 12,121,126 B2
(45) Date of Patent: Oct. 22, 2024

(54) SUITCASE CONVERTIBLE INTO A TATTOO BED

(71) Applicant: Federico Costantini, Aprilia (IT)

(72) Inventor: Federico Costantini, Aprilia (IT)

( * ) Notice: Subject to any disclaimer, the term of this patent is extended or adjusted under 35 U.S.C. 154(b) by 166 days.

(21) Appl. No.: 17/797,847

(22) PCT Filed: Mar. 2, 2021

(86) PCT No.: PCT/IB2021/051723

§ 371 (c)(1),
(2) Date: Aug. 5, 2022

(87) PCT Pub. No.: WO2021/176345

PCT Pub. Date: Sep. 10, 2021

(65) Prior Publication Data

US 2023/0058919 A1 Feb. 23, 2023

(30) Foreign Application Priority Data

Mar. 3, 2020 (IT) ..... 102020000004438

(51) Int. Cl.

| | |
|---|---|
| ***A45C 15/00*** | (2006.01) |
| ***A45C 5/14*** | (2006.01) |
| ***A45C 9/00*** | (2006.01) |
| ***A47C 17/82*** | (2006.01) |

(52) U.S. Cl.

CPC ..... *A45C 15/00* (2013.01); *A45C 5/14* (2013.01); *A45C 9/00* (2013.01); *A47C 17/82* (2013.01)

(58) Field of Classification Search

CPC .. A45C 15/00; A45C 5/14; A45C 9/00; A45C 17/82

USPC ..... 206/216

See application file for complete search history.

(56) References Cited

U.S. PATENT DOCUMENTS 3,544,157 A * 12/1970 Emanuel ..... A47C 4/52 297/118
3,614,794 A * 10/1971 Rodgers ..... A47C 17/82 5/119
4,034,518 A * 7/1977 Trecker ..... A47C 17/82 43/109

(Continued)

FOREIGN PATENT DOCUMENTS

| | | |
|---|---|---|
| GB | 2515050 A | 12/2014 |
| JP | 201942364 A | 3/2019 |
| WO | 2020036416 A1 | 2/2020 |

OTHER PUBLICATIONS

International Search Report and Written Opinion issued on May 10, 2021, in connection with corresponding International Application No. PCT/IB2021/051723; 9 pages.

*Primary Examiner* — Ernesto A Grano
(74) *Attorney, Agent, or Firm* — Maier & Maier, PLLC

(57) ABSTRACT

A suitcase convertible into a tattoo bed, including a parallelepiped body equipped with lower wheels, and with a extractable handle a first hollow portion and a second hollow portion hinged to each other along a central profile of a lower portion of the parallelepiped body. The suitcase is positionable reversibly between an open configuration, in which the first hollow portion and the second hollow portion are extended horizontally, and a closed configuration, in which the first hollow portion and the second hollow portion are adjacent to each other to form the parallelepiped body.

9 Claims, 5 Drawing Sheets

(56) References Cited

U.S. PATENT DOCUMENTS

| | | | | |
|---|---|---|---|---|
| 5,316,096 | A * | 5/1994 | Good | A45C 5/14 280/37 |
| 5,611,414 | A * | 3/1997 | Walker | A47C 17/82 5/722 |
| 8,439,174 | B1 * | 5/2013 | Miranda | A45C 5/14 383/4 |
| 9,867,437 | B1 * | 1/2018 | Dohmann | A45C 15/06 |
| 11,044,973 | B1 * | 6/2021 | Easterwood | A47G 9/10 |
| 11,497,316 | B1 * | 11/2022 | Habchi | A47C 17/70 |
| 2004/0108757 | A1 * | 6/2004 | Jackson | A47C 1/143 297/229 |
| 2010/0108451 | A1 * | 5/2010 | Pain | A47C 17/82 190/115 |
| 2013/0249176 | A1 * | 9/2013 | Bengtzen | B62B 1/20 280/30 |
| 2013/0256072 | A1 * | 10/2013 | Farhat | A47C 4/52 5/112 |
| 2017/0071355 | A1 * | 3/2017 | Oh | A47C 17/82 |
| 2019/0313751 | A1 * | 10/2019 | Zhou | A45C 9/00 |
| 2020/0000191 | A1 * | 1/2020 | Dohmann | F16M 13/005 |
| 2020/0022472 | A1 | 1/2020 | Qi et al. | |
| 2020/0221879 | A1 * | 7/2020 | Habchi | A47C 17/82 |
| 2021/0177113 | A1 * | 6/2021 | Zhang | A45F 3/02 |
| 2022/0039529 | A1 * | 2/2022 | Shim | A45C 13/04 |
| 2022/0167751 | A1 * | 6/2022 | Smith | A45C 13/262 |
| 2022/0232988 | A1 * | 7/2022 | Dungee | A47C 17/82 |

* cited by examiner

SUITCASE CONVERTIBLE INTO A TATTOO BED

FIELD

The present invention relates to a suitcase convertible into a tattoo bed.

In particular, the present invention relates to a suitcase convertible into a tattoo bed of the type usable as a tattoo bed.

BACKGROUND

Types of multifunction cases are currently known.

A first example is reported in the patent application US2019/0320815 which describes an apparatus convertible from suitcase to bed which comprises a first container and a second container, each of which surrounds a cavity. The containers are joined at their respective ends and include a raised perimeter lip extending along the ends and sides. The first and second containers being selectively positionable in an open configuration and a closed configuration.

Another solution is described in patent application US2013/0256072 which outlines a suitcase configured to be transformed into a bed. The device includes a frame with a hinge. The frame is fixed to a first portion and a second portion. The second portion is pivotally connected to a first portion about the hinge. The first portion and the second portion respectively comprise a first internal face and a second internal face. The first inner face includes a first mattress and the second inner face includes a second mattress. At least one portion includes a fastening device such as to releasably attach the second portion to the first portion. When the first portion and second portion are in an open configuration, the first and second mattresses form the bed.

Furthermore, the patent application WO2011/141605 describes a multifunction suitcase which comprises an inflatable mattress and an inflation element such as to inflate the mattress without having to open the suitcase. The suitcase is made up of elements of simple construction that can be easily repaired and/or replaced in case of failure.

Furthermore, the GB2191682A patent reports a suitcase/chair or a bed combination comprising a structure configurable in a first position in which it constitutes a frame for a chair or a bed and in a second position in which it forms the frame of a suitcase. A cover is provided to cover the structure in its second position in order to store clothing or personal items.

U.S. Pat. No. 8,016,089, on the other hand, describes a combination of suitcase and chair. The device includes four legs and a support that allow the device to be used as a chair. The legs are equipped with a telescopic system to adjust the height. The support rotates and attaches to a second section so that the second section is a backrest with adjustable tilt.

However, convertible suitcases, such as those described here, are not compact enough and cannot be converted into a tattoo bed.

In addition, the known convertible suitcases are equipped with minimal accessories and not sufficient to transport in a compact and practical way both a tattoo bed and accessories such as a stool, a support for the arm of an operator and a lamp.

SUMMARY

The purpose of the present invention is to provide a suitcase that can be converted into a tattoo bed that is handy, compact and that allows the internal transport of both a tattoo bed and accessories such as a stool, a support for the arm of an operator and a lamp in a compact and practical way, therefore, having characteristics such as to overcome the limits of current suitcases convertible into a tattoo bed.

According to the present invention, a suitcase convertible into a tattoo bed is made.

BRIEF DESCRIPTION OF THE FIGURES

For a better understanding of the present invention, a preferred embodiment is now described, purely by way of non-limiting example, with reference to the attached drawings, in which.

DETAILED DESCRIPTION

Figure 1C:
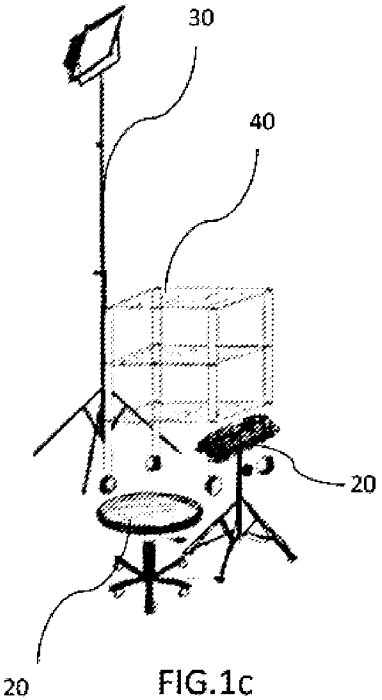
FIG. 1 shows a three-dimensional view of a first embodiment of a suitcase convertible into a tattoo bed, according to the invention.
Figure 1B:
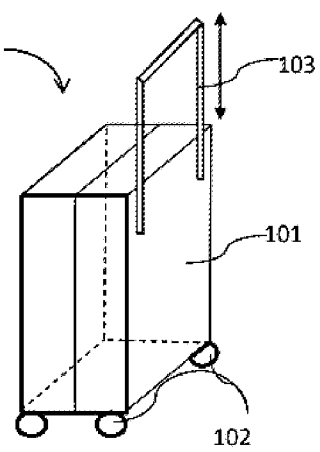
Figure 1A:
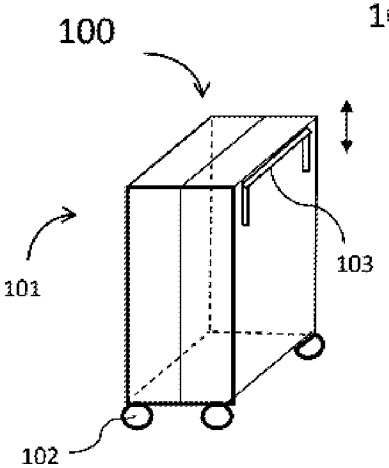

With reference to these figures, a suitcase convertible into a tattoo bed is shown. In particular, FIG. 1 shows a first embodiment of a suitcase 100 convertible into a tattoo bed, comprising a parallelepiped body 101 equipped with lower wheels 102, for example one under each lower corner of the parallelepiped body 101, and a removable handle 103 located in an upper portion of one of the faces with a larger surface of the parallelepiped body 101.

According to an aspect of the invention, the body 101 comprises a first hollow portion 101*a* and a second hollow portion 101*b* hinged together along a central profile 105 of the lower surface of the parallelepiped body 101.

According to an aspect of the invention, the second hollow portion 101*b* is the same as the first hollow portion 101*a* and mirrors it.

According to an aspect of the invention, the first hollow portion 101*a* comprises a first pair of removable legs 101*aa* and the second hollow portion 101*b* comprises a second pair of removable legs 101*bb* each rotatable outwards when the suitcase 100 is configured in the open position.

According to one aspect of the invention, the removable legs 101*aa* and 101*bb* are telescopic and adjustable in height. Furthermore, the extractable legs 101*aa* and 101*bb* are equipped with a locking system that prevents the load of a user lying or sitting on the bed, or on the suitcase in an open configuration, from causing a collapse of the legs or their involuntary shortening.

Figure 2C:
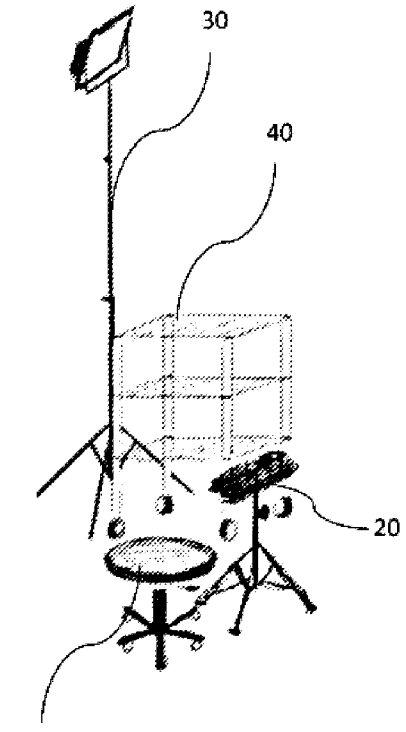
FIG. 2 shows a three-dimensional view of a second embodiment of the suitcase convertible into a tattoo bed, according to the invention.
Figure 2B:
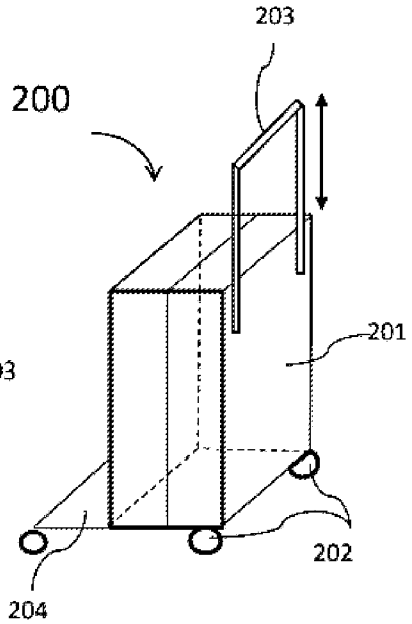
Figure 2A:
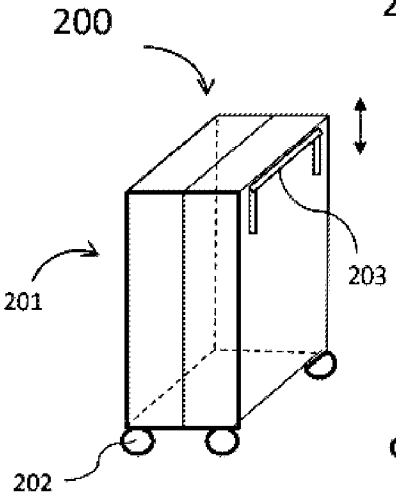

FIG. 2 shows a second embodiment of a suitcase 200 convertible into a tattoo bed, comprising a parallelepiped body 201 comprising a first hollow portion 201*a* and a second hollow portion 201*b* equal to the first hollow portion 201*a* hinged along a central line 205 of the lower surface of the parallelepiped body 201. Furthermore, the parallelepiped body 201 is equipped with first lower rollers 202*a* in correspondence with the first hollow portion 201*a* and second lower wheels 202*b* larger than the first lower wheels 202*a* in correspondence with the second hollow portion 201*b*. Furthermore, the parallelepiped body 201 is equipped with an extractable handle 203 placed in an upper portion of one of the faces with a larger surface of the parallelepiped body 201.

According to an aspect of the invention, each hollow portion 201*a* and 201*b* respectively comprises a pair of removable legs 201*aa* and 201*bb*.

According to one aspect of the invention, the removable legs 201*aa* and 201*bb* are telescopic and adjustable in height. Furthermore, the removable legs 201*aa* and 201*bb* are equipped with a locking system that prevents the load of a user lying or sitting on the bed, or on the suitcase 200 in the open configuration, from causing the legs to collapse or to shorten them involuntarily.

According to another aspect of the invention, the parallelepiped body 201 is equipped with a platform 204 and an electric motor with adjustable speed suitable for moving the suitcase 200. The suitcase 200 is advantageously configured to carry a user who can stand on the platform 204 and keep in balance by placing the hands on the handle.

Figure 3B:
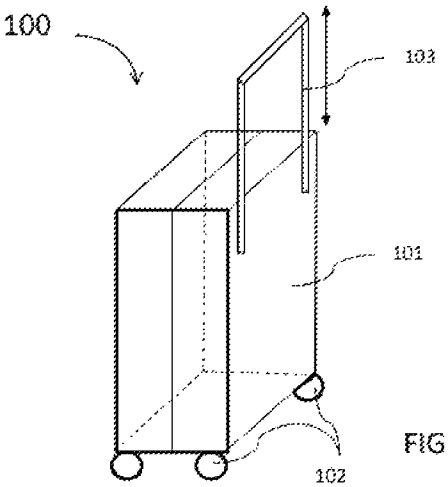
FIG. 3*b* shows a view in closed configuration with open extractable handle according to the invention.
Figure 3A:
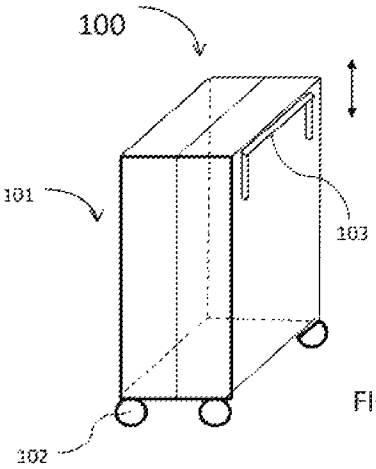
FIG. 3*a* shows a view in closed configuration according to the invention.
Figure 3C:
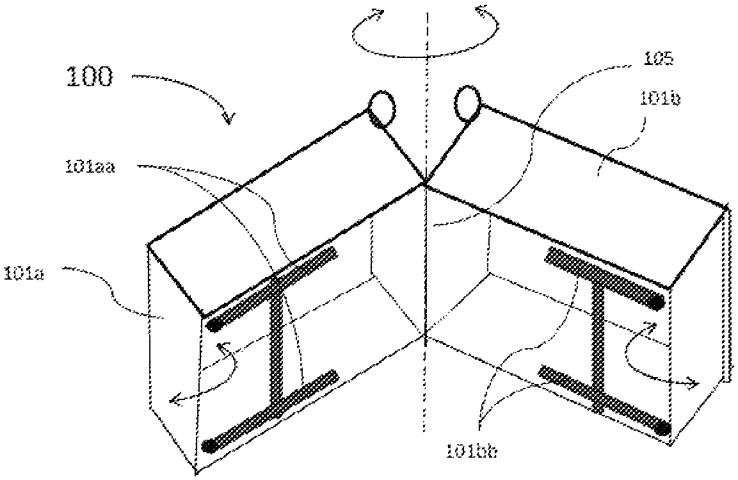
FIG. 3*c* shows a view in the opening phase according to the invention.
Figure 3D:
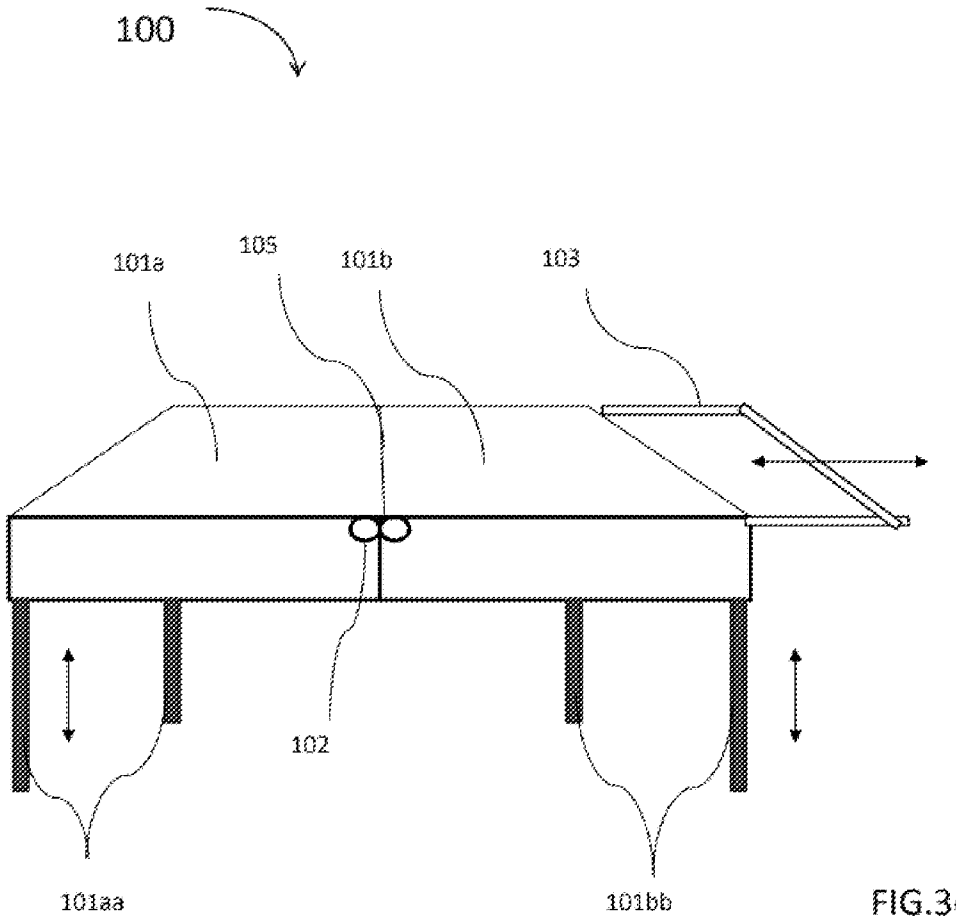
FIG. 3*d* shows an open configuration view with legs extracted of the suitcase convertible into a tattoo bed according to the invention.

According to an aspect of the invention, the lower wheels 102, 202 are orientable and can be positioned on a lateral surface of the suitcase 100, 200 convertible into a tattoo bed when arranged in an open configuration, as shown in FIG. 3*d*.

According to an embodiment, the suitcase 100, 200 contains inside it, in closed configuration, a stool 10, a support 20 for an operator's arm, a support for electronic devices, for example a tablet, a LED lamp 30 and a support trolley 40 equipped with shelves, constituting as a whole a complete work station.

According to an aspect of the invention, the suitcase 100,200 comprises a plurality of internal compartments in order to contain inside it, in closed configuration, a stool 10, a LED lamp 30 comprising a lamp pole with dimensions preferably equal to 67 cm×7 cm and a lamp case with dimensions preferably equal to 31 cm×33 cm. Also, the suitcase 100, 200 contain a side table with preferable dimensions equal to 35 cm×35 cm and height equal to 60 cm having foldable legs. Said arm support 20 has preferred dimensions equal to 67 cm×7 cm.

Advantageously according to the invention, the suitcase 100, 200 allows to transport in a compact and practical way an entire workstation of a tattoo artist.

Advantageously, according to the invention, the suitcase 100, 200 allows you to transport in a compact and practical way even by plane or train an entire workstation of a tattoo artist with a minimum size and a weight of less than 25 kg.

In use, the suitcase 100, 200 can be placed in an open configuration, the first and second pair of removable legs 101*aa*, 201*aa* and 101*bb*, 201*bb* are then extracted from the respective cavities and positioned on the support surface, and the two hollow portions 101*a*, 101*b*, 201*a*, 201*b* of the suitcase 100, 200 are extended horizontally and joined together so as to form a plane supported by the removable legs 101*aa*, 201*aa* and 101*bb*, 201*bb*. In this way the suitcase 100, 200 can be transformed into a tattoo bed. In closed configuration, the first and second pair of removable legs 101*aa*, 201*aa* and 101*bb*, 201*bb* are folded internally into the two hollow portions 101*a*, 101*b*, 201*a*, 201*b* and two hollow portions 101*a*, 101*b*, 201*a*, 201*b* are contiguous to each other, while the lower wheels 102, 202 rest on the ground.

According to one aspect of the invention, the convertible suitcase 100, 200 includes a folding mattress inside, not shown in the figure. Preferably, the collapsible mattress is made of transpiring and non-absorbent material, advantageously ensuring maximum hygiene tattoo making operations.

Figure 4:
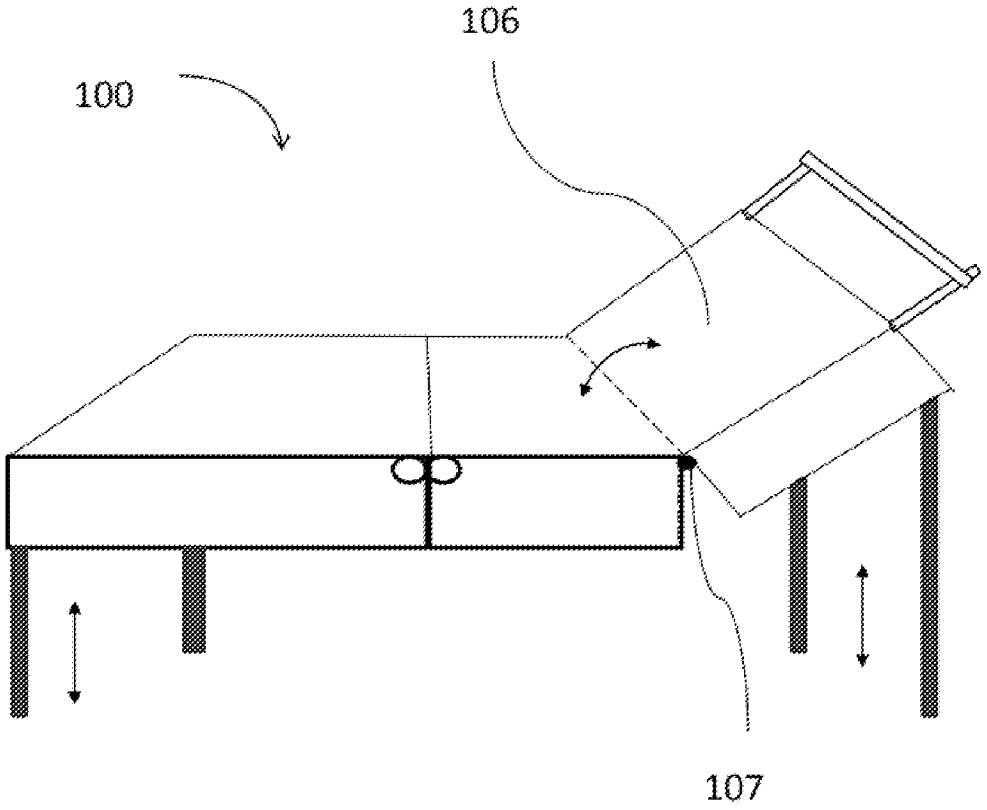
FIG. 4 shows a view in open configuration and reclined headrest of the suitcase convertible into a tattoo bed, according to the invention.

According to an aspect of the invention, the suitcase 100,200 comprises a reclining backrest 106, 206 by means of an additional hinge 107, 207, as shown in FIG. 4 referring by way of example to the suitcase 100. A similar system is applied to the second embodiment of the suitcase 200.

According to an aspect of the invention, the parallelepiped body 101 is made in carbon fiber.

According to an aspect of the invention, the suitcase 100, 200 when in closed configuration, has height comprised between 65 cm and 75 cm, preferably equal to 69.5 cm, width comprised between 42 cm and 52 cm, preferably equal to 48 cm, and depth comprised between 25 cm and 35 cm, preferably equal to 29.5 cm.

According to an aspect of the invention, the reclining backrest 106, 206 is made of two tubular elements on which a weft of elastic canvas is placed. On said backrest 106, 206 a user can be accommodated.

According to an aspect of the invention, the width of the reclining backrest 106, 206 is approximately equal to the width of the suitcase 100, 200. The reclining backrest 106, 206 length will be about 60 cm (of which about 10 cm will be inserted in the grafts to stabilize the suitcase structure). The plug holes for the reclining backrest 106, 206 will have a depth of about 10 cm and will be positioned about 10 cm from the smaller dimension of the shell on which they are made.

To facilitate the transport of the suitcase 100, 200, four wheels will be mounted. When the suitcase 100, 200 is opened and converted in a tattoo bed, said wheels are positioned towards the outside of the suitcase.

According to an aspect of the invention, the suitcase 100, 200 is equipped with an adjustable handle and a lock, advantageously suitable for transportation to the USA.

According to an aspect of the invention, the suitcase 100, 200 comprises a support structure, made up of profiles perimeter internally secured to the carbon fiber body. A 'C' shaped element connects the support structure to the legs 101*aa*, 101*bb*. Also, said 'C' shaped element has a hinge to which said legs 101*aa*, 101*bb* are connected to allow its rotation.

According to an aspect of the invention, each couple of legs 101*aa*, 101*bb* is equipped with a telescopic system and comprises an horizontal support connecting two legs, and two a foldable element, configured to stabilize the suitcase when in opened configuration.

Advantageously, the reclining backrest 106, 206 allows to increase the comfort of a user lying on the suitcase that can be converted into a bed in an open configuration.

Therefore, the suitcase convertible into a tattoo bed according to the invention allows all the devices necessary for a tattoo artist to be transported in a compact and practical manner, while maintaining an overall weight and overall dimensions compatible with the limits set for air transport.

Finally, it is clear that modifications and variations can be made to the suitcase convertible into a tattoo bed according to the invention described and illustrated here without departing from the protective scope of the present invention, as defined in the attached claims.

The invention claimed is:

1. A suitcase assembly convertible into a tattoo bed, comprising:

a parallelepiped body equipped with lower wheels, and with an extractable handle placed in an upper portion of the parallelepiped body, a first hollow portion and a second hollow portion hinged to each other along a central profile of a lower portion of the parallelepiped body, characterized in being positionable reversibly between an open configuration, in which the first hollow portion and the second hollow portion are extended horizontally, and a closed configuration, in which the first hollow portion and the second hollow portion are adjacent to each other to form the parallelepiped body, the suitcase assembly containing therein a stool, a support for an operator's arm, a support for electronic devices, a LED lamp and a trolley for stand equipped with shelves, when it is arranged in the closed configuration.

2. The suitcase assembly convertible into the tattoo bed, according to claim 1, wherein the first hollow body comprises a first pair of extractable legs and the second hollow portion comprises a second pair of extractable legs.

3. The suitcase assembly convertible into the tattoo bed, according to claim 2, wherein the first and the second pair of extractable legs are telescopic and height adjustable.

4. The suitcase assembly convertible into the tattoo bed, according to claim 2, wherein the first and the second pair of extractable legs are equipped with a locking system able to prevent that a load on the suitcase in open configuration, can cause a collapse of the first and the second pair of extractable legs or their involuntary shortening.

5. The suitcase assembly convertible into the tattoo bed, according to claim 1, wherein said lower wheels are swiveling and positionable on a side surface of the suitcase assembly when arranged in the open configuration.

6. The suitcase assembly convertible into the tattoo bed, according to claim 1, wherein said first and second pair of extractable legs are extracted from respective cavities ad positioned on a support surface when the suitcase assembly is in said open configuration, and the first and second pair of extractable legs is folded inside the first and second hollow portions when the suitcase assembly is in said closed configuration.

7. The suitcase assembly convertible into the tattoo bed, according to claim 1, further comprising, in its interior, a foldable mattress, made of breathable and non-absorbent material.

8. The suitcase assembly convertible into the tattoo bed, according to claim 1, further comprising a backrest reclinable by an additional hinge.

9. The suitcase assembly convertible into the tattoo bed, according to claim 1, wherein said parallelepiped body comprises a platform and an electronic motor with adjustable speed suitable for moving the suitcase assembly.

* * * * *